US005274937A

United States Patent [19]

Birnbaum

[11] Patent Number: 5,274,937

[45] Date of Patent: Jan. 4, 1994

[54] MAGNETIC HOLDER

[76] Inventor: Irving Birnbaum, 2501 W. Peterson Ave., Chicago, Ill. 60659

[21] Appl. No.: 802,544

[22] Filed: Dec. 5, 1991

[51] Int. Cl.[5] ..... G09F 7/04; G09F 3/18

[52] U.S. Cl. ..... 40/600; 40/661; 206/818

[58] Field of Search ..... 40/600, 649, 661, 662, 40/642; 248/206.5; 206/818

[56] References Cited

U.S. PATENT DOCUMENTS 2,527,482 10/1950 Kinzler et al. ..... 206/818 X
2,741,572 4/1956 Lennartz ..... 40/649 X
2,825,447 3/1958 Kurland ..... 206/818 X
3,698,111 10/1972 Smith ..... 40/600 X
3,744,542 7/1973 Stephens et al. ..... 206/818 X
4,258,493 3/1981 Kettlestrings et al. ..... 40/600
4,475,300 10/1984 Ledenican ..... 40/600

*Primary Examiner*—Kenneth J. Dorner
*Assistant Examiner*—J. Bonifanti
*Attorney, Agent, or Firm*—Y. Judd Azulay

[57] ABSTRACT

A flexible magnetic holder capable of coupling to a metallic surface having a pocket open on its top and one side for storing materials which can be readily inserted and removed from the holder.

1 Claim, 1 Drawing Sheet

Fig. 1
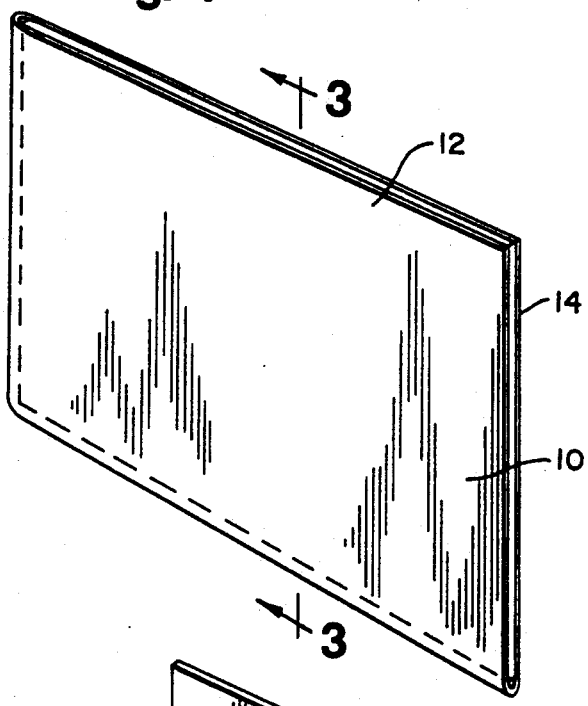
Fig. 4
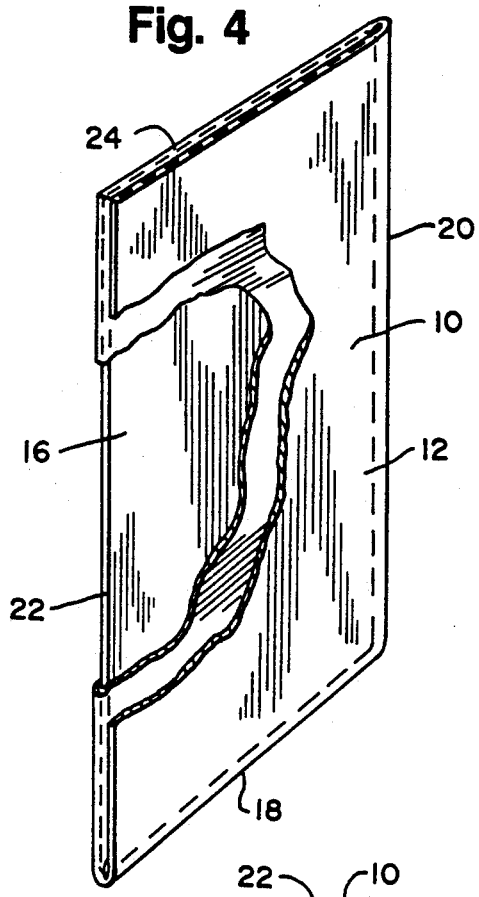
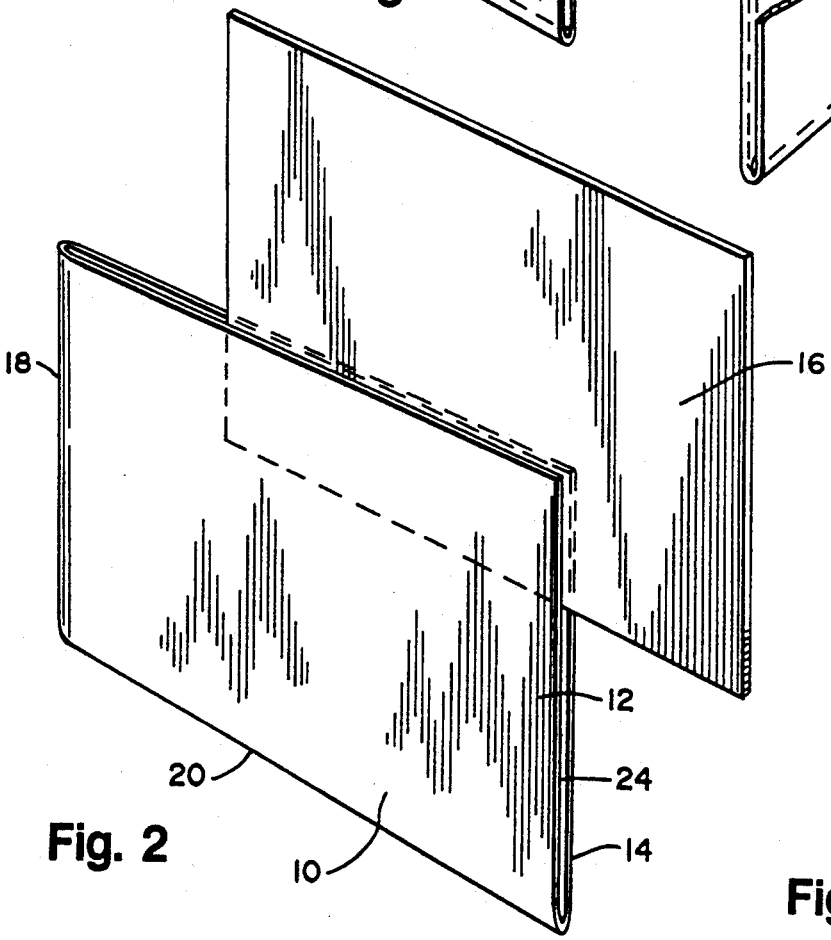
Fig. 2
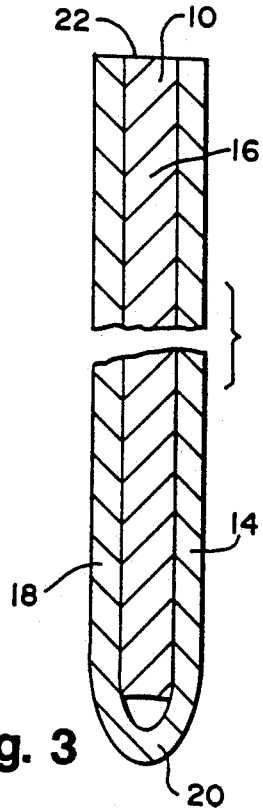
Fig. 3

MAGNETIC HOLDER

BACKGROUND AND SUMMARY OF THE INVENTION

The present invention relates to flexible holders and more particularly to flexible magnetized holders having pockets.

Magnetized holders while highly desirable have certain drawbacks that can limit their usefulness. Generally, the foremost drawback is that the magnet necessary to adhere the holder to a metallic surface, is bulky and not easily moved from one surface to another. In addition, to keep material within the holder, a magnet proportional to the weight of the material must be used. Thus, larger magnets must be used for higher weight material.

Attempts have been made to overcome the aforementioned shortcomings. However, the attempts have met with only limited success due to the fact that permanent magnets are not flexible and surfaces are not always regular to allow for total adhesion.

U.S. Pat. No. 4,100,684 relates to a holder device having a permanent magnet mounted on one side thereof. The holder device is broken into compartments and a permanent magnet is made to be mounted in a housing which is permanently affixed to a stationary object.

U.S. Pat. No. 4,826,054 relates to a portable and foldable magnetic tool holder. The holder includes magnetic bars which are positioned in the interior of the holder. The magnets as positioned are used to adhere the tool holder to a metallic surface and for adhesion of metallic tools within the holder.

Other attempts have been made in an effort to obtain flexible magnetized holders. These efforts require that the magnetic material be adjacent the metallic surface. In addition, the holders have defined specific pockets for holding specific items.

The present invention provides a flexible magnetic holder that overcomes the drawbacks of the prior art. Specifically, the present invention provides a lightweight, flexible magnetic holder having a magnet which is included within the holder. This magnet may be removable or permanent depending on the intended use of the holder.

SUMMARY OF THE INVENTION

The holder in accordance with this invention includes flexible material having two opposite faces. A sheet of flexible magnetic material is within the opposite faces of the flexible material. The flexible material's opposite faces are mounted together at two points to define a pocket between the opposite faces open at one side and its top.

In particular forms, the flexible material holder and the magnetic sheet are equilateral with the openings in said holder being on adjacent sides of the equilateral holder.

BRIEF DESCRIPTION OF THE DRAWINGS

The objects and features of the invention may be understood with reference to the following detailed description of an illustrative embodiment of the invention, taken together with the accompanying drawings, in which:

FIG. 1 is a perspective view of the inventive holder;

FIG. 2 is an exploded perspective view showing the flexible holder and the flexible magnetic sheet;

FIG. 3 is side section view of the inventive holder; and

FIG. 4 is an alternative embodiment of the inventive holder.

DESCRIPTION OF THE PREFERRED EMBODIMENT

Referring now to the drawings wherein the figures are for the purpose of illustrating the preferred embodiment of the invention only and not for the purpose of limiting same, FIG. 1 shows a flexible holder 10 having two faces 12, 14 and containing a flexible magnetized sheet 16. The faces 12, 14 of the holder 10 are fastened together to form one vertical side 18 and the bottom 20 of the holder. By this configuration the faces form a pocket open at one vertical edge 24 and the top 22 of the pocket which allows ready insertion of material into the holder.

The faces 12, 14 of the flexible holder 10 can be made of a variety of flexible material such as paper, cardboard, polyethylene, and other plastic material. This material can be opaque, transparent, translucent, etc. Written material can be present on the outer surface of the faces. As an alternative by having a transparent holder 10, written material can be inserted into the holder so as to be legible through the transparent face. This flexible insert can be attached to a face 12, of the holder 10 and folded so as to be viewable through the face 12 of the flexible holder. It also can be permanently attached to the face of the holder, or it can be inserted in the holder without being attached to a face.

Referring to FIG. 2, the sheet of magnetic material 16 can be placed within the faces 12, 14 of the flexible holder 10 so that it can easily be removed. This embodiment allows for ready removal of the thin sheet magnet from the flexible holder 10 as desired by the user. This can be accomplished by many means including but not limited to insertion of a thin sheet magnet into the pocket of the holder, attaching the magnetic sheet onto an edge of a face 12, 14 such that the thin magnetic sheet 16 can be in one position within the faces of the holder and in its second position outside of the faces of the holder, whereby the magnetic sheet 16 can be inserted between the faces or removed therefrom, and still be connected to an edge. Other means for placing the magnet within the faces of the holder such that it can be readily removed therefrom, are within the scope of this invention.

Referring to FIG. 3, it can be seen that the flexible holder 10 of the present invention has adequate space in its pocket for the thin flexible magnetic sheet 16 and other materials which can be conveniently inserted and removed through the top 22 and its open end 24.

Referring to FIG. 4, as an alternative embodiment, the thin flexible magnetic sheet 16 can be permanently affixed within the faces 12, 14 of the flexible holder 10. This embodiment of the present invention is of particular practical usefulness since the magnetic sheet 16 by being permanently placed within the pocket of the holder 10, provides a complete unit for coupling of the holder with a metallic surface and has sufficient space within the pocket for the placement of materials which can be readily removed therefrom as desired by the user.

This placement of the thin sheet permanent magnet can be accomplished by various procedures. A convenient method for the permanent placement of the magnetic sheet 16 within the flexible holder 10 is to adhere the magnetic sheet to one of the inner surfaces of faces 12, 14 of holder 10 at their closed ends 18, 20. This makes the placement of the magnet permanent without interfering with the use of the pocket. As an alternative, the permanent magnet can be affixed to an inner surface of one of the faces of the holder. Other methods for permanently placing the flexible thin magnetic sheet into the holder 10 can be used and are within the scope of the present invention.

As can be seen from the foregoing description, the present invention provides a flexible holder for a variety of materials, the holder capable of being coupled to a magnetic surface.

In particular the present invention provides a flexible holder capable of coupling with a magnetic surface without the need for external magnets, hooks, fasteners, etc. Also the holder of the present invention permits the ready insertion and removal from the pocket formed by the two faces being mounted together on bottom and one vertical side. Thus the top and one vertical side of the holder are open which is advantageous for many uses of the holder.

The present invention has been described with reference to specific embodiments and advantages. Variations of the foregoing description will be known to those skilled in the art.

I claim:

1. In a holder capable of magnetically coupling with a metallic surface, said holder comprising a first, flexible surface face, a second, flexible surface face parallel to said first surface face, and a flexible magnetized sheet, each of said first and second surface faces comprising a first edge surface, a second edge surface perpendicular to said first edge surface, a third edge surface perpendicular to said second edge surface and parallel to said first edge surface, and a fourth edge surface perpendicular to said third edge surface and parallel to said second edge surface, said edge surfaces of said first surface corresponding to and juxtapositioned with said edge surfaces of said second surface face, the improvement comprising:

said first and second surface faces being permanently secured to each other at said corresponding, juxapositioned first and second edge surfaces, said corresponding, juxtapositioned third and fourth edge surfaces of said first and second surface faces being free of securement, in order to form a partially-open pocket that is open from two, mutually-perpendicular edges;

said flexible magnetized sheet being sandwiched between said first and second surface faces and held therein via said permanently secured first and second edge surfaces of said first and second surface faces forming said pocket;

said flexible magnetized sheet being approximately of the same size as said first and second surface faces;

each of said first and second surface faces being made of flexible, see-through material by means of which said flexible magnetized sheet is visible from outside said holder for displaying a message and advertisement;

said flexible magnetized sheet being removably mounted in said pocket, said flexible magnetized sheet being capable of removal and insertion into said pocket via said open third and fourth edge surfaces of said first and second surface faces.

* * * * *